US011109677B2

(12) United States Patent
Adams

(10) Patent No.: US 11,109,677 B2
(45) Date of Patent: Sep. 7, 2021

(54) SHELF ASSEMBLIES THAT DISPLAY ILLUMINATED INDICIA

(71) Applicant: SCHOTT Gemtron Corporation, Sweetwater, TN (US)

(72) Inventor: Brian Adams, Vincennes, IN (US)

(73) Assignee: SCHOTT Gemtron Corporation, Sweetwater, TN (US)

( * ) Notice: Subject to any disclaimer, the term of this patent is extended or adjusted under 35 U.S.C. 154(b) by 0 days.

(21) Appl. No.: 16/289,699

(22) Filed: Mar. 1, 2019

(65) Prior Publication Data

US 2020/0275779 A1 Sep. 3, 2020

(51) Int. Cl.
*A47B 96/02* (2006.01)
*A47B 97/00* (2006.01)

(52) U.S. Cl.
CPC ..... *A47B 96/02* (2013.01); *A47B 97/00* (2013.01)

(58) Field of Classification Search
CPC ..... A47B 96/02; A47B 97/00
See application file for complete search history.

(56) References Cited

U.S. PATENT DOCUMENTS 2,308,726 A 1/1943 Swanson et al.
3,084,463 A * 4/1963 Guyer ..... G09F 3/20 40/564
3,086,308 A * 4/1963 Ternouth ..... G09F 3/20 40/541
3,248,494 A * 4/1966 Barnes ..... F21V 23/04 200/51 R
4,843,524 A * 6/1989 Krent ..... A47B 13/12 362/127
5,220,739 A * 6/1993 Chich ..... G09F 13/04 40/550
5,287,252 A * 2/1994 Caruso ..... F25D 25/02 312/223.5
5,530,628 A * 6/1996 Ngai ..... F21V 13/12 362/33
5,626,084 A * 5/1997 Kelly ..... A47B 96/02 108/23
5,911,496 A * 6/1999 Hojnacki ..... A47B 3/12 108/23
6,179,434 B1 * 1/2001 Saraiji ..... A47F 3/001 108/23
6,231,205 B1 * 5/2001 Slesinger ..... A47B 96/02 362/125
6,276,810 B1 8/2001 Vosshenrich
6,364,273 B1 * 4/2002 Otema ..... A47F 5/0043 248/235
6,558,017 B1 * 5/2003 Saraiji ..... A47F 3/001 108/23
6,672,552 B1 * 1/2004 Jao ..... F21V 33/0032 248/251
6,758,573 B1 * 7/2004 Thomas ..... A47B 97/00 362/133

(Continued)

FOREIGN PATENT DOCUMENTS

DE 10311492 B3 * 12/2004 ..... A47B 97/00
DE 102007059171 A1 * 4/2009 ..... A47B 97/00

(Continued)

*Primary Examiner* — Stanton L Krycinski

(57) ABSTRACT

The present disclosure describes shelf assemblies having illuminated frames for products including appliances such as refrigerators.

16 Claims, 9 Drawing Sheets

(56) References Cited

U.S. PATENT DOCUMENTS 6,786,562 B2 * 9/2004 Obrock ..... C03B 23/033 211/153
7,163,305 B2 * 1/2007 Bienick ..... A47B 97/00 362/125
7,201,487 B2 * 4/2007 Pinter ..... A47B 96/02 362/133
7,260,438 B2 * 8/2007 Caldwell ..... A47B 57/00 108/108
7,559,672 B1 * 7/2009 Parkyn ..... A47B 97/00 362/127
7,574,822 B1 * 8/2009 Moore ..... G09F 3/204 40/575
7,597,462 B2 * 10/2009 Misof ..... A47B 97/00 362/33
7,600,887 B2 * 10/2009 Sherman ..... A47B 97/00 362/125
7,614,350 B2 * 11/2009 Tuttle ..... A47B 97/00 108/23
7,648,251 B2 * 1/2010 Whitehouse ..... A47B 97/00 362/133
8,135,482 B2 * 3/2012 Caldwell ..... A47B 57/00 211/119.003
8,172,096 B2 * 5/2012 Van De Steen ..... A47B 96/02 211/119.003
8,215,795 B2 * 7/2012 Pichel ..... A47F 11/10 362/249.02
8,746,916 B2 * 6/2014 Oketani ..... A47F 3/001 312/114
9,222,645 B2 * 12/2015 Breslow ..... F21V 5/007
9,287,021 B2 * 3/2016 Hammond ..... F21V 33/0044
9,377,578 B2 * 6/2016 Gooden ..... F25D 27/00
9,404,645 B1 * 8/2016 Feng ..... F21V 23/001
9,408,480 B2 * 8/2016 O'Toole ..... A47F 5/16
9,679,503 B2 * 6/2017 Weyer ..... G09F 13/18
9,789,823 B2 * 10/2017 Salter ..... B60R 7/02
9,904,001 B2 * 2/2018 Sherman ..... G02B 6/0065
9,995,477 B2 * 6/2018 Miedema ..... F21V 33/0024
10,161,608 B2 * 12/2018 Pallai ..... F21V 21/096
10,278,523 B2 * 5/2019 Ringel ..... A47F 11/10
10,702,078 B1 * 7/2020 Walker ..... G09F 3/208
2006/0181885 A1 * 8/2006 Seng Tong ..... A47B 96/02 362/382
2009/0001037 A1 * 1/2009 Wilcock ..... A47B 96/02 211/119.003
2012/0106129 A1 * 5/2012 Glovatsky ..... G02B 6/0095 362/92
2014/0376213 A1 * 12/2014 Miedema ..... F21V 33/0024 362/127
2015/0023000 A1 * 1/2015 Kendall ..... F25D 25/02 362/92
2015/0070928 A1 3/2015 Rau
2015/0289650 A1 * 10/2015 Yau ..... A47B 95/00 29/434

FOREIGN PATENT DOCUMENTS

DE 102010017346 A1 * 2/2011 ..... A47B 96/02
DE 102014202941 A1 8/2015
JP 2010264226 A 11/2010
WO 9849490 A1 11/1998
WO 2011114026 A1 9/2011
WO 2018051100 A1 3/2018

* cited by examiner

SHELF ASSEMBLIES THAT DISPLAY ILLUMINATED INDICIA

BACKGROUND OF THE DISCLOSURE

1. Field of the Disclosure

The present disclosure describes shelf assemblies for products including appliances such as refrigerators. The shelf assemblies display illuminated indicia.

2. Description of the Related Art

The exterior of refrigerators and other products are aesthetically designed to make the product more appealing, but the interiors of those products often lack aesthetic appeal and can appear bland and very similar.

When a brand name or other distinguishing markings or designs are displayed in the interior of an appliance, they are usually applied by printing, laser marking, decals or engraving/molding. Design elements displayed in these manners do not stand out and have minimal value and appeal.

Lighting and electronics to illuminate the design elements are usually not feasible due to cost and loss of visual appeal.

SUMMARY OF THE DISCLOSURE

The present disclosure describes shelf assemblies with illuminated indicia for products including appliances such as refrigerators. The illuminated indicia can be the brand name of the product manufacturer, a company logo, an aesthetic design or any other text, image or pattern.

The indicia can be illuminated using a lighting system that is integral to the shelf assembly and simultaneously illuminates both the indicia and an area beneath the shelf assembly. The lighting system can create both a high intensity focused light to illuminate the area beneath the shelf assembly and a soft subtle glow to illuminate the indicia so that the illuminated indicia is immediately recognizable by the user.

In some embodiments, the shelf assembly comprises a shelf panel having a top surface, a bottom surface, side surfaces and a front surface. The side and front surfaces are generally perpendicular to the top surface and the bottom surface. A frame can cover at least a portion of the side, top, bottom and/or front surface of the shelf panel. A lighting system can emit a first portion of light toward the frame and a second portion of light in a direction away from the shelf panel and/or away from the frame. The first portion of light can travel through the frame to illuminate an indicia and the second portion of light can illuminate an area beneath the shelf panel.

The indicia can be created and illuminated in many different ways. For example, the frame can be substantially transparent or substantially translucent and can be partly covered by a substantially non-transparent or a substantially non-translucent material to produce a covered frame segment and an uncovered frame segment. The first portion of light can be substantially obstructed by the covered frame segment and substantially unobstructed by the uncovered frame segment. In this embodiment, the uncovered frame segment forms the indicia that is illuminated.

In other embodiments, the frame can be substantially non-transparent or substantially non-translucent and can comprise an open segment or a substantially transparent or a substantially translucent portion within a perimeter of the frame. The first portion of light can be substantially obstructed by the substantially non-transparent or substantially non-translucent frame and substantially unobstructed by the open segment or the substantially transparent or substantially translucent portion. The open segment or the substantially transparent or substantially translucent portion form the indicia that is illuminated in this embodiment.

In other embodiments, the frame can be substantially transparent or substantially translucent or substantially non-transparent or substantially non-translucent and can comprise an open segment within a perimeter of the frame. An element of the lighting system can protrude into the open segment. The first portion of light can be unobstructed by the open segment so that the element of the lighting system is visible when viewing the lighting system from the opposite side of the frame. In these embodiments, the element of the lighting system that protrudes into the open segment forms the indicia that is illuminated in this embodiment.

DETAILED DESCRIPTION OF THE DISCLOSURE

The present disclosure describes shelf assemblies that support any object, such as bookshelves, display units and refrigerator shelves. The shelf assemblies display an indicia that is illuminated to be visible to a user. The indicia can be the brand name of the product manufacturer, a company logo, an aesthetic design or any other text, image or pattern.

Figure 1:
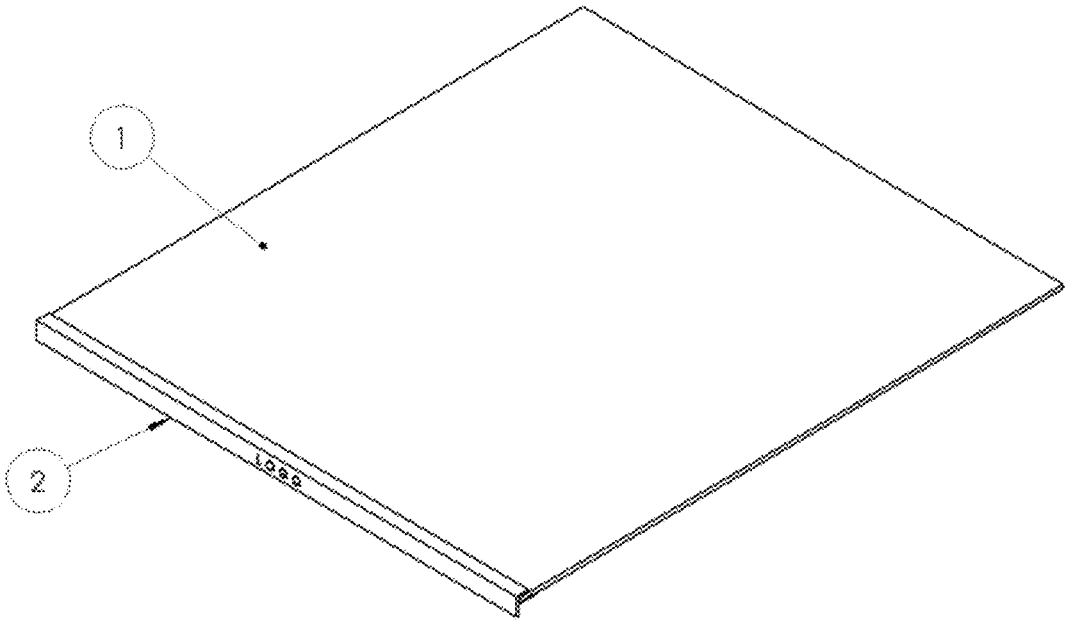
FIG. 1 shows a shelf assembly having the illuminated indicia "logo" in the center of the frame.

The shelf assembly can comprise a shelf panel having a top surface, a bottom surface and side and front surfaces that are generally perpendicular to the top surface and the bottom surface. FIG. 1 shows a shelf panel 1 having a frame 2 that covers a portion of the top and front surfaces of the shelf panel 1. The frame can be an element that protects the shelf panel from damage, such as when items are placed onto the shelf panel. The frame can be mounted to the front surface of the shelf panel as shown in FIG. 1, mounted to the brackets that support the shelf panel, or mounted in any other conventional location. The shelf panel can be composed of glass or any other suitable material.

Figure 2:
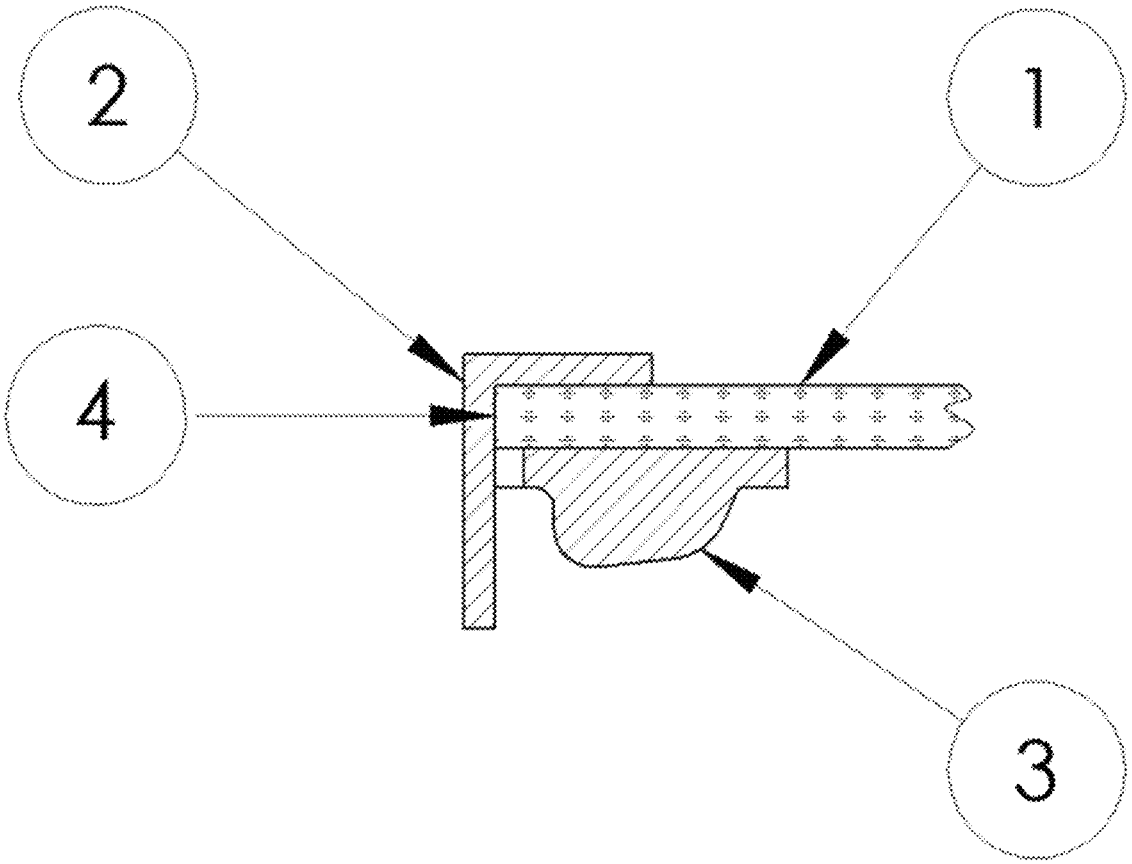
FIG. 2 shows possible locations for the frame and the lighting system.

The lighting system 3 can be located below the top surface of the shelf panel 1 and adjacent to the front surface 4 of the shelf panel 1. The lighting system can be located elsewhere. FIG. 2 shows the lighting system 3 located entirely below the bottom surface of the shelf panel and connected to the bottom surface of the shelf panel, but the lighting system can have other locations, such as completely or partially within the bottom surface of the shelf panel.

The lighting system can be integral to the shelf assembly and can comprise one or more lighting units. An integral lighting system is a lighting system that is primarily supported by one or more components of the shelf assembly as opposed to a lighting system that is primarily supported by a wall of a refrigerator. The lighting system can create both a soft subtle glow in a first direction toward the frame and that travels through the frame to illuminate the indicia and a high intensity focused light in a second direction away from the shelf panel and/or away from the frame. The second direction can be any one or more angles from about 45-180 degrees away from the first direction. The soft subtle glow can illuminate the indicia and the high intensity focused light can illuminate the area beneath the shelf assembly. In some embodiments, such as the embodiment in FIG. 2, the frame covers all or substantially all of the lighting system to obstruct the lighting system or a substantial portion thereof from view when the shelf assembly is viewed from the front.

The indicia is a portion of the shelf assembly that is illuminated to depict the brand name of the product manufacturer, a company logo, an aesthetic design, or any text, image or pattern. The indicia can be formed in many ways, such as being the illuminated negative space formed within cutout portions of a substantially non-transparent or substantially non-translucent film that covers a substantially transparent or substantially translucent frame, such as being the illuminated open segment or the illuminated substantially non-transparent or substantially non-translucent portion of the frame, or such as being the illuminated element of a lighting system that protrudes into an open segment of the frame.

Figure 3:
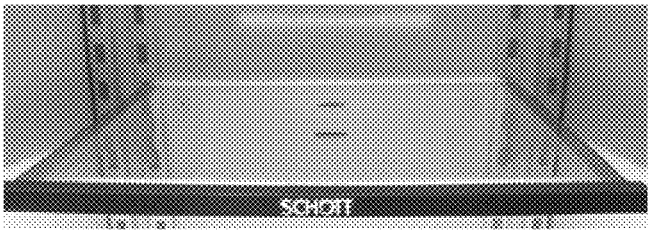
FIG. 3 shows an embodiment where the frame is substantially transparent or substantially translucent and is partly covered by a substantially non-transparent or substantially non-translucent material.

FIG. 3 illustrates an embodiment where the frame is substantially transparent or substantially translucent and is partly covered by a substantially non-transparent or substantially non-translucent material to produce a covered frame segment and an uncovered frame segment. The first portion of light is substantially obstructed by the covered frame segment and substantially unobstructed by the uncovered frame segment. In this embodiment, the uncovered frame segment forms the indicia that is illuminated, such as for example as shown in FIG. 3 where the illuminated indicia is the company name SCHOTT. In some embodiments, the uncovered frame segment can comprise at least 5% of the front or another surface area of the frame, at least 10%, or at least 20%.

Figure 4:
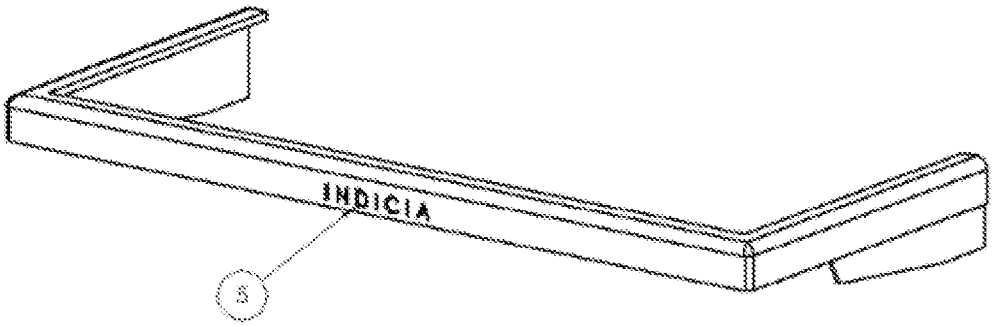
FIG. 4 shows an embodiment where the frame is substantially non-transparent or substantially non-translucent and comprises an open segment having the indicia "indicia" within a perimeter of the frame.
Figure 5:
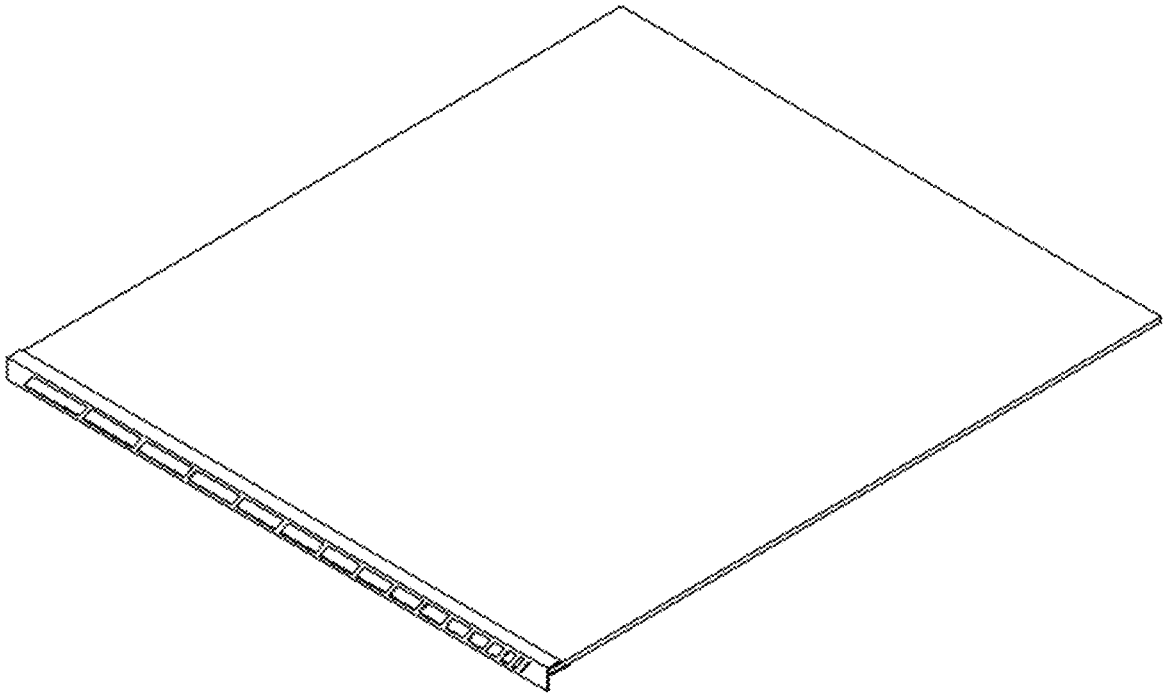
FIG. 5 shows an embodiment where the frame is substantially non-transparent or substantially non-translucent and comprises an open segment having a pattern within a perimeter of the frame.
Figure 6:
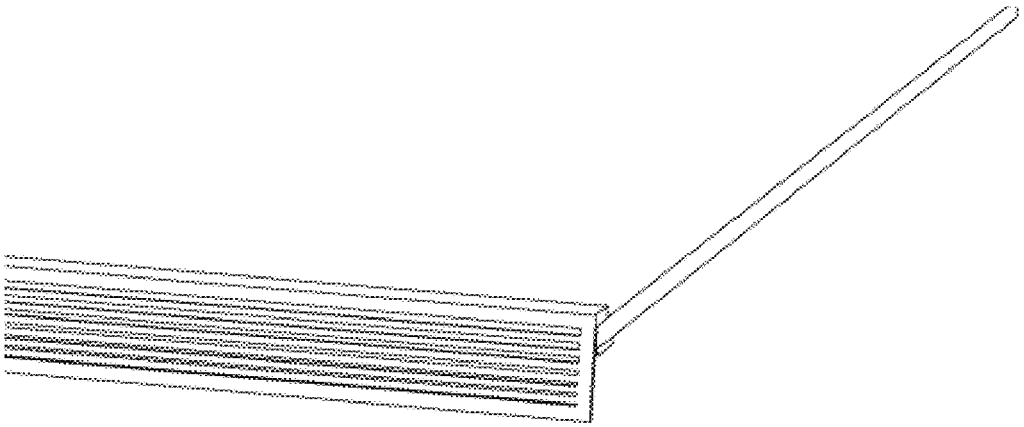
FIG. 6 shows an embodiment where the frame is substantially non-transparent or substantially non-translucent and comprises an open segment having a pattern within a perimeter of the frame.

In FIGS. 4-6, embodiments are illustrated where the frame is substantially non-transparent or substantially non-translucent and comprises an open segment within a perimeter of the frame. The first portion of light is substantially obstructed by the substantially nontransparent or substantially non-translucent frame and substantially unobstructed by the open segment. The open segment is the indicia that is illuminated, such as in FIG. 4 which shows the text "indicia" as illuminated indicia 5. In some embodiments, the open segment can comprise at least 5% of the front or another surface area of the frame, at least 10%, or at least 20%.

In another embodiment, the open segment is replaced with or covered by a substantially transparent or substantially translucent material. The first portion of light is substantially obstructed by the substantially non-transparent or substantially non-translucent frame and substantially unobstructed by the substantially transparent or substantially translucent material. The substantially transparent or substantially translucent material is the indicia that is illuminated. In some embodiments, the substantially transparent or substantially translucent material can cover at least 5% of the front or another surface area of the frame, at least 10%, or at least 20%.

Figure 7:
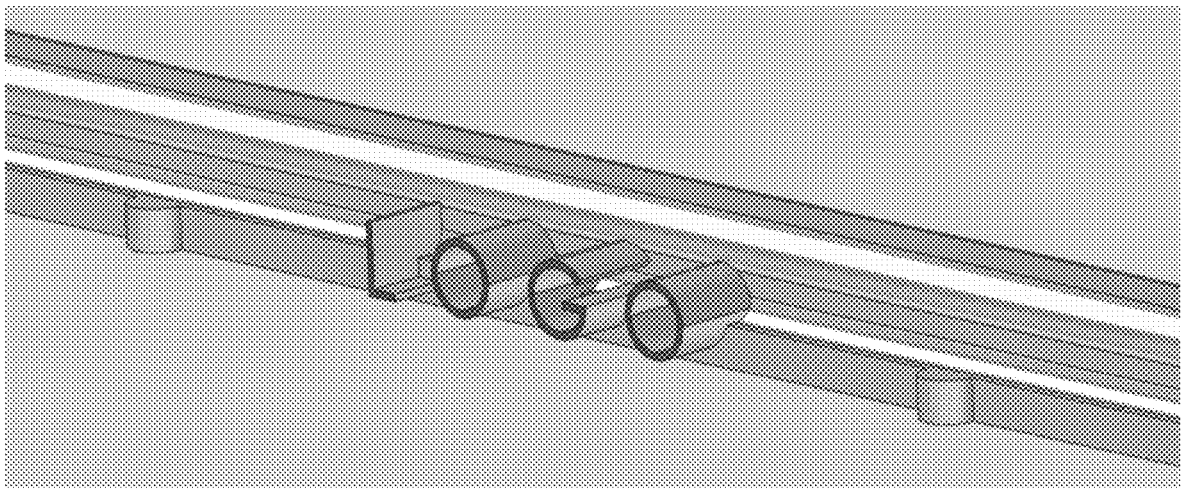
FIG. 7 shows a lens having the indicia "logo" that can protrude through the frame.
Figure 8:
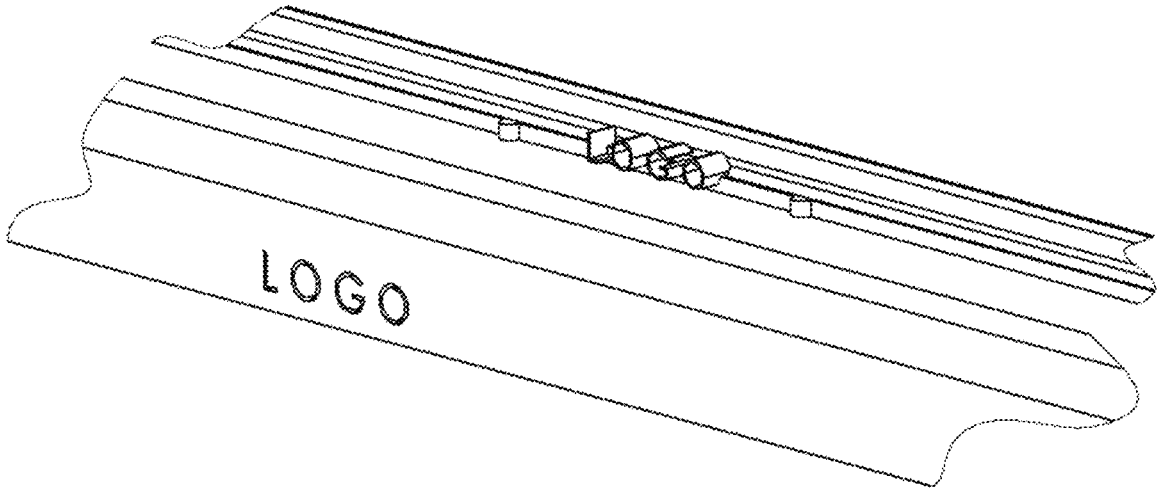
FIG. 8 shows a lighting system with a lens that protrudes into an open segment within the frame.

In another embodiment, FIGS. 7-8 illustrate an open segment within a perimeter of the frame. The frame can be substantially transparent or substantially translucent or substantially non-transparent or substantially non-translucent. An element of the lighting system, such as a lens, protrudes into the open segment. The first portion of light is substantially unobstructed by the substantially transparent or substantially translucent frame, or substantially obstructed by the substantially non-transparent or substantially non-translucent frame, and substantially unobstructed by the open segment, so that the element of the lighting system is visible when viewing the lighting system from the opposite side of the frame. In these embodiments, the element of the lighting system that protrudes into the open segment forms the indicia that is illuminated, such as in FIGS. 7-8 which show a lens having the indicia "logo" molded into the lens. This indicia can protrude through the frame and be illuminated. In some embodiments, the open segment can comprise at least 5% of the front or another surface area of the frame, at least 10%, or at least 20%.

The lighting system can emit a first portion of light toward the frame and that travels through the frame to illuminate the indicia and a second portion of light in a direction away from the shelf panel and/or away from the frame to illuminate an area beneath the shelf panel, such as for example in a direction generally perpendicular to the first portion of light or from 45-180 degrees away from the first portion of light. The first and second portions of light can be simultaneously provided by one lighting unit or by multiple lighting units. FIG. 2 illustrates an embodiment where a single lighting unit simultaneously provides the first and second portions of light.

The amount of light that is provided in the first direction and in the second direction depends on the lighting system that is used and the desired light distribution. In some embodiments, the majority of light is distributed in the second direction compared to the first direction, such as for example about 60-90 percent or about 70-80 percent of the light is distributed in the second direction. In order to simultaneously distribute light in the first and second directions using a single lighting unit, the lighting unit can include a lens with a geometry and composition designed to distribute different amounts of light in different directions. For example, the lens composition can include resins or other materials that cause a different percentage of light to transmit in each direction.

Substantially transparent, substantially translucent and substantially unobstructed means that more than 50% of visible light is transmitted through the element. Substantially non-transparent, substantially non-translucent and substantially obstructed means 50% or less visible light is transmitted through the element. Possibly more important is that two elements are visually distinguishable when illuminated, such as by transmitting different amounts of visible light so that one illuminated element can be visually distinguished from another illuminated element.

The substantially transparent or substantially translucent material can be plastic, resin, glass, glass-ceramic, a film, a coating, or any suitable material. The substantially non-transparent material or substantially non-translucent can be plastic, resin, metal, glass, glass-ceramic, a film, a coating, or any suitable material. The materials can have surface texturing from sand blasting, brushing, etching or from other mechanisms to form part of the indicia that is illuminated or to form the entire indicia that is illuminated. The frame can be composed of a substantially transparent or substantially translucent or substantially non-transparent or substantially non-translucent plastic, resin, metal, glass, glass-ceramic, or any suitable material.

As shown in FIG. 2, the frame can extend over the top surface of the shelf panel, across the front of the shelf panel, and lower than the top and bottom surfaces of the shelf panel. The frame however can have any other suitable shape and location. For example, the frame can extend over the top surface of the shelf panel, across the front of the shelf panel, but not beneath the bottom surface of the shelf panel. The frame can be parallel to the front surface of the shelf panel while extending only across the top surface of the shelf panel, only below the bottom surface of the shelf panel, both across and below, or neither across nor below. A portion of the frame can be beneath the shelf panel and sandwiched between the shelf panel and the lighting system.

Figure 9:
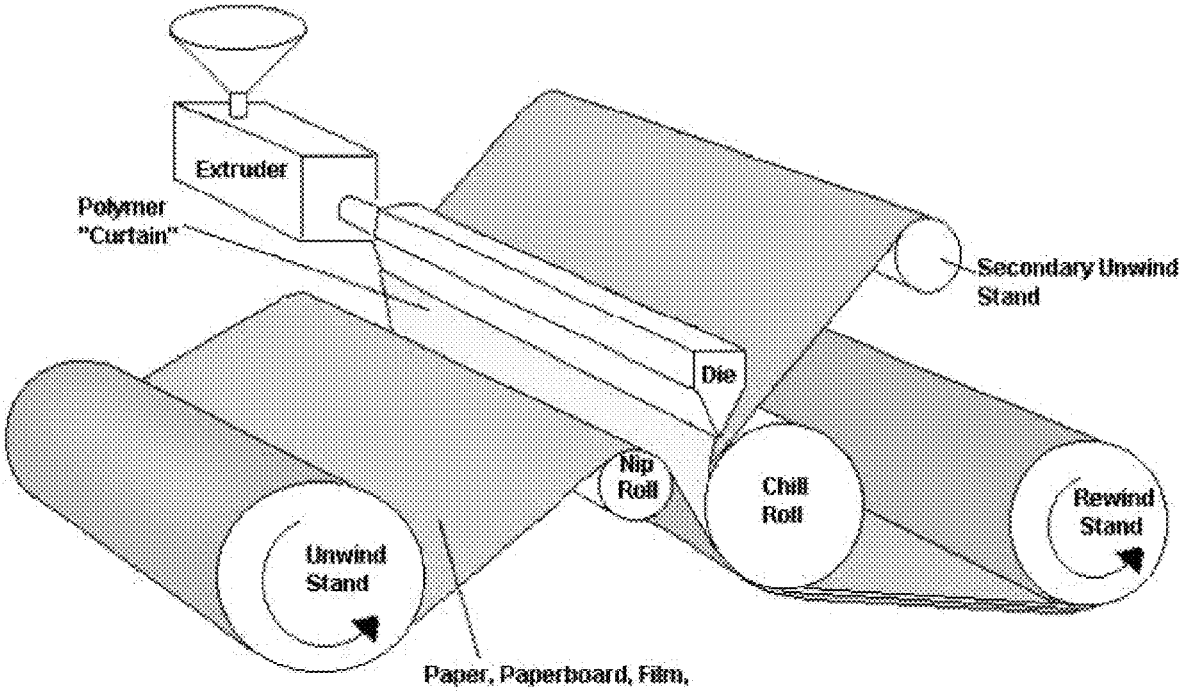
FIG. 9 shows an apparatus that can apply a substantially non-transparent or substantially non-translucent material at the same time as the material for the frame is extruded.

The substantially non-transparent or substantially non-translucent material can be applied to the exterior surface of the frame in a number of different ways. For example, the frame can be applied to the shelf panel by extrusion and the substantially non-transparent material or substantially non-translucent can be laminated to the frame. Before or after lamination, segments within the perimeter of the frame can be removed/cut-out to provide open segments through the frame where light can travel without being blocked by the frame. FIG. 9 shows an apparatus that can apply the substantially non-transparent or substantially non-translucent material to the frame at the same time as the material for the frame is extruded.

The open segments of the frame and the materials applied to the frame can be in any desired location. For example, as shown in FIG. 4, the open segments can be located within a surface of the frame that is parallel to the front surface of the shelf panel, and as shown in FIG. 3, the substantially non-transparent or substantially non-translucent material can be applied to a surface of the frame that is parallel to the front surface of the shelf panel.

The shelf assembly can include first and second shelf brackets to support the shelf panel. The first shelf bracket can support one side of the shelf panel and the second shelf bracket can support the other side as typically done for refrigerator shelving. The shelf brackets may or may not connect to the frame.

The lighting system can be powered in any manner. For example, the lighting system can have a battery or can be powered by a power supply that is in electrical communication with at least one of the first and second shelf brackets, so that the power flows through one of the brackets to power the lighting system.

The invention claimed is:

1. A shelf assembly comprising:

a shelf panel having a top surface, a bottom surface and a front surface that is generally perpendicular to the top surface and the bottom surface;

a frame comprising a frame segment that covers a portion of the front surface of the shelf panel; and a lighting system that emits a first portion of light in a first direction toward the frame and a second portion of light in a second direction away from the shelf panel and/or away from the frame;

wherein the first portion of light travels through the frame segment that covers the portion of the front surface of the shelf panel to illuminate an indicia and the second portion of light illuminates an area beneath the shelf panel, and wherein a) the frame is partly covered by a substantially non-transparent or substantially non-translucent material applied to the frame to produce a covered frame segment and an uncovered frame segment and wherein the uncovered frame segment is the illuminated indicia, or b) the illuminated indicia is an open segment within a perimeter of the frame.

2. The shelf assembly of claim 1, wherein about 60-90 percent of the emitted light is distributed in the second direction.

3. The shelf assembly of claim 1, wherein the second direction is about 45-180 degrees away from the first direction.

4. The shelf assembly of claim 1, wherein the frame is substantially transparent or substantially translucent and the first portion of light is obstructed by the covered frame segment and not obstructed by the uncovered frame segment.

5. The shelf assembly of claim 4, wherein the substantially non-transparent or substantially non-translucent material is a film or a coating.

6. The shelf assembly of claim 1, wherein the uncovered frame segment is the illuminated indicia.

7. The shelf assembly of claim 1, wherein the frame is substantially non-transparent or substantially non-translucent, wherein the open segment is substantially transparent or substantially translucent and the first portion of light is substantially obstructed by the frame and not obstructed by the open segment.

8. The shelf assembly of claim 1, wherein the open segment is the illuminated indicia.

9. The shelf assembly of claim 1, wherein the open segment is substantially transparent or substantially translucent.

10. The shelf assembly of claim 1, wherein an element of the lighting system protrudes into the open segment.

11. The shelf assembly of claim 10, wherein the element is a lens.

12. The shelf assembly of claim 10, wherein the element of the lighting system is the indicia that is illuminated.

13. The shelf assembly of claim 1, wherein the lighting system is located below the top surface of the shelf panel.

14. The shelf assembly of claim 1, wherein the lighting system is located below the top surface of the shelf panel and adjacent to the front surface of the shelf panel.

15. The shelf assembly of claim 1, wherein the lighting system is connected to the bottom surface of the shelf panel.

16. The shelf assembly of claim 1, wherein the frame covers the lighting system.

* * * * *